US010787306B2

(12) United States Patent
Rusch

(10) Patent No.: US 10,787,306 B2
(45) Date of Patent: Sep. 29, 2020

(54) DISPENSER FOR VISCOUS MATERIALS

(71) Applicant: Server Products, Inc., Richfield, WI (US)

(72) Inventor: Gerald A. Rusch, Fond du Lac, WI (US)

(73) Assignee: Server Products, Inc., Richfield, WI (US)

( * ) Notice: Subject to any disclaimer, the term of this patent is extended or adjusted under 35 U.S.C. 154(b) by 0 days.

(21) Appl. No.: 16/590,860

(22) Filed: Oct. 2, 2019

(65) Prior Publication Data

US 2020/0108999 A1 Apr. 9, 2020

Related U.S. Application Data

(63) Continuation-in-part of application No. 16/152,511, filed on Oct. 5, 2018.

(51) Int. Cl.
*B65D 83/00* (2006.01)

(52) U.S. Cl.
CPC ..... *B65D 83/0072* (2013.01)

(58) Field of Classification Search
CPC ..... B65D 35/30; B65D 35/38
USPC ..... 222/387, 481, 484, 485, 488, 494, 547, 222/564
See application file for complete search history.

(56) References Cited

U.S. PATENT DOCUMENTS 2,507,557 A * 5/1950 Chester ..... B65D 83/06 222/455
2,634,692 A * 4/1953 Sherbondy ..... A23G 3/28 425/172
3,161,325 A * 12/1964 Hinkel ..... A61M 3/00 222/80
3,174,653 A * 3/1965 McEachran ..... B05C 17/0123 222/181.2
3,591,053 A * 7/1971 Thomas ..... B65D 35/38 222/485
3,884,396 A * 5/1975 Gordon ..... G01F 11/026 222/327
4,318,499 A * 3/1982 Hamilton ..... B05C 17/0113 222/327
4,323,176 A * 4/1982 Sartain ..... B65D 83/0022 222/326

(Continued)

*Primary Examiner* — Patrick M. Buechner
*Assistant Examiner* — Michael J. Melaragno
(74) *Attorney, Agent, or Firm* — Andrus Intellectual Property Law, LLP

(57) ABSTRACT

A dispenser for dispensing a viscous material contained in a flexible package includes a body extending along a longitudinal axis that has a first end, an opposite second end, a cavity configured to receive the flexible package, and a handle assembly coupled to the first end. The handle assembly has a fixed handle, a trigger pivotally coupled to the fixed handle, and a rod extending between the fixed handle and the trigger into the cavity. A plurality of dispensing valves are positioned at the second end of the body and configured to dispense the viscous material, and a piston is movably disposed in the cavity for engagement with the flexible package. As the trigger is pivoted toward the fixed handle, the rod moves along the longitudinal axis toward the piston such that the piston engages the flexible package and the viscous material dispenses through the plurality of dispensing valves.

19 Claims, 5 Drawing Sheets

(56) References Cited

U.S. PATENT DOCUMENTS 4,432,473 A * 2/1984 MacEwen ..... B65D 83/0072 222/327
4,461,407 A * 7/1984 Finnegan ..... B05C 17/0126 222/327
4,768,683 A * 9/1988 Gold ..... G01F 11/24 222/328
4,830,231 A * 5/1989 Smith ..... B65D 83/0005 222/327
4,966,537 A * 10/1990 Bowles ..... A23G 3/28 222/323
5,156,305 A * 10/1992 Eyre ..... B05C 17/01 222/327
5,277,318 A * 1/1994 Smalley, Jr. ..... B07B 1/06 209/255
5,297,702 A * 3/1994 Crosby ..... B67D 7/0227 222/185.1
5,375,740 A * 12/1994 Umetsu ..... A23G 3/2023 222/95
5,529,225 A * 6/1996 Chang ..... B05C 17/01 222/391
5,556,008 A * 9/1996 Silver ..... A61J 7/0023 222/192
5,788,126 A * 8/1998 Chang ..... B05C 17/01 222/327
6,026,985 A * 2/2000 Elliott, Sr. ..... A21C 11/18 222/1
6,176,399 B1 * 1/2001 Schantz ..... B65D 47/2031 222/484
6,648,181 B2 * 11/2003 Whittaker ..... A61J 7/0053 222/391
6,655,554 B2 * 12/2003 Pantelleria ..... A47J 47/01 222/327
6,732,888 B1 5/2004 Smiley et al.
D521,863 S 5/2006 Davis et al.
7,037,094 B1 * 5/2006 Lee ..... A47G 19/183 222/327
7,959,038 B2 * 6/2011 de Oliveira ..... B65D 83/0005 222/326
8,146,781 B2 * 4/2012 Robertson ..... B23P 19/10 222/327
8,256,978 B2 9/2012 Bencsics et al.
8,511,520 B2 * 8/2013 Van Wijk ..... B05C 17/00576 222/287
8,561,854 B2 * 10/2013 Tirone ..... A23G 3/2015 222/182
D698,616 S * 2/2014 Van Wijk ..... D7/672
8,650,736 B2 * 2/2014 Robertson ..... B31B 50/74 29/428
9,333,605 B2 * 5/2016 Robertson ..... B31B 50/74
9,376,239 B2 * 6/2016 Edamatsu ..... B65D 47/103
9,481,495 B2 * 11/2016 Bellmore ..... B65D 75/5883
9,694,944 B2 * 7/2017 Long ..... B65D 35/08
2005/0167447 A1 8/2005 Barraclough
2006/0118580 A1 6/2006 Spencer
2007/0215649 A1 * 9/2007 Tirone ..... A23G 3/2015 222/391
2007/0217860 A1 9/2007 Byun
2008/0023495 A1 1/2008 Takayama et al.
2008/0245380 A1 10/2008 Ecker et al.
2009/0159613 A1 * 6/2009 Rusch ..... B65D 83/0072 222/95
2010/0089953 A1 * 4/2010 Lakic ..... A47G 19/183 222/309
2012/0228334 A1 * 9/2012 Van Wijk ..... B05C 17/0126 222/287
2013/0126558 A1 5/2013 Schneider et al.
2013/0153600 A1 * 6/2013 Sanfilippo ..... B65D 35/30 222/95
2013/0233886 A1 * 9/2013 Long ..... B65D 35/08
2014/0008397 A1 * 1/2014 Edamatsu ..... B65D 47/103 222/326
2015/0307236 A1 * 10/2015 Bellmore ..... B65D 75/583 222/95

* cited by examiner

FIG. 11
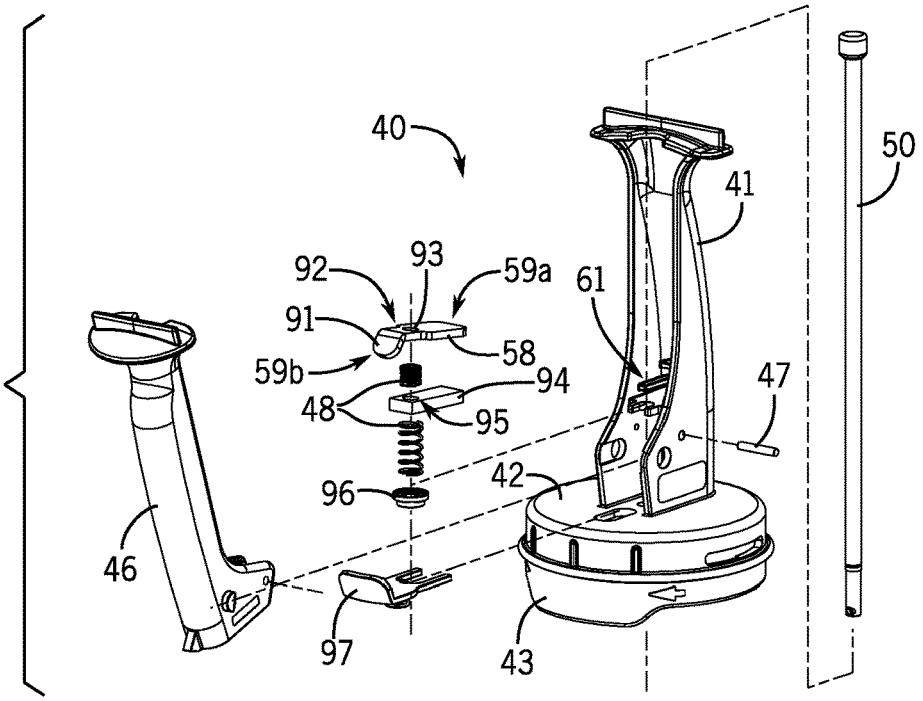
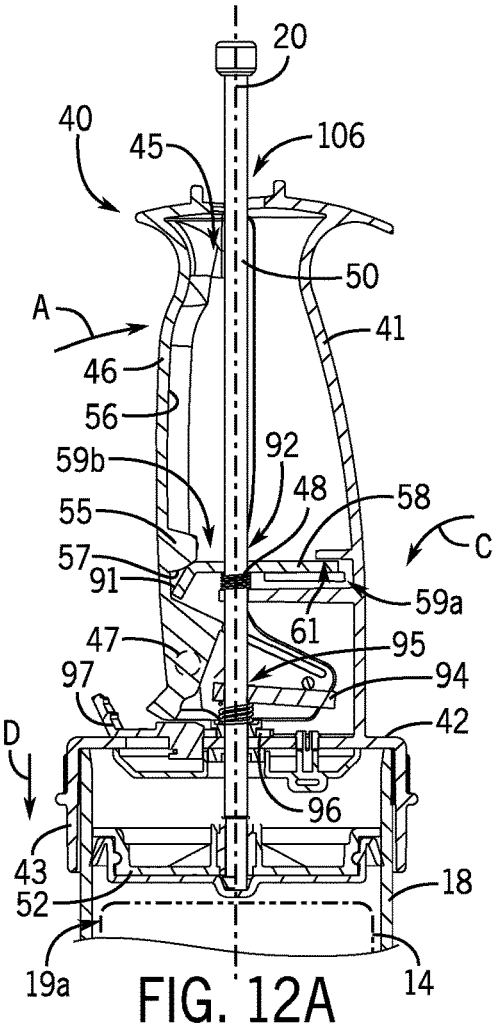
FIG. 12A
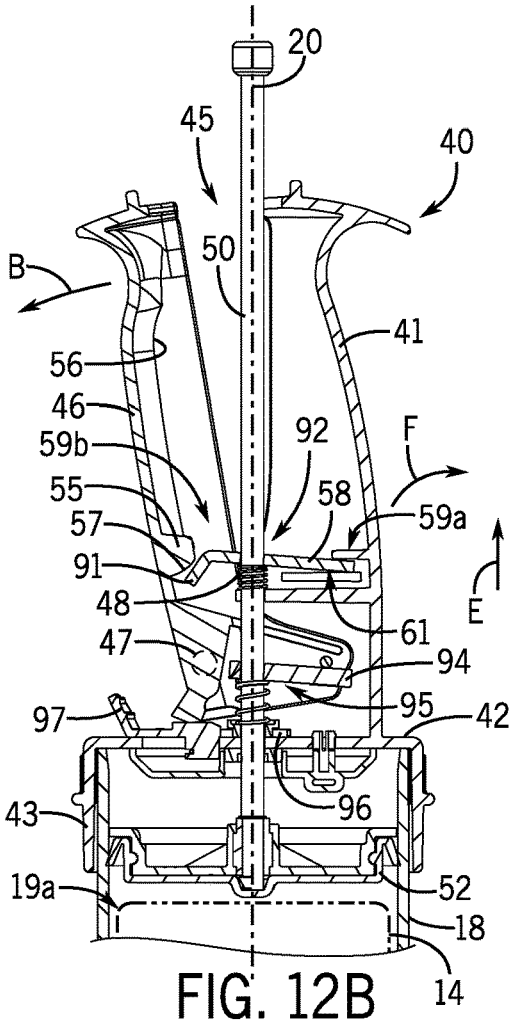
FIG. 12B

DISPENSER FOR VISCOUS MATERIALS

CROSS-REFERENCE TO RELATED APPLICATION

The present application is a continuation-in-part application of and claims priority from U.S. patent application Ser. No. 16/152,511 filed Oct. 5, 2018, the disclosure of which is incorporated herein by reference.

FIELD

The present disclosure generally relates to dispensers and, more particularly, pertains to hand-held dispensers for discharging viscous materials.

BACKGROUND

A variety of hand-held, manually operated dispensers are known for selectively dispensing thick, flowable viscous materials, such as paste-like extrudable materials in the form of gels, foams, adhesives, and the like. One area in which dispensers of the present disclosure have particular application is the food industry where pre-packaged charges of viscous food products, such as cheese, whipped topping, icing, and food condiments, are to be dispensed.

Many of these food product dispensers include a housing or body for replaceably receiving a flexible package of a food product to be dispensed. The dispenser typically has a dispensing end and a piston slideably mounted within the body. Dispensers of this type usually include a handle having a pivotably mounted trigger which is squeezed by a user to activate a piston advancing arrangement. Such piston advancing arrangement commonly includes an elongated rod that is advanced by a pawl mechanism linking the rod and the piston. One portion of the rod is adapted for contact with the piston and propels the piston as the user manipulates the trigger. As the piston is advanced, the food product is dispensed from the dispensing end.

To refill the dispenser with a new flexible package, the dispenser is disassembled and the new flexible package is inserted. While refilling the dispenser, residual food product at the dispensing end may spill out or be cleaned from the dispensing end. Accordingly, the residual food product is lost thereby increasing costs and refill frequency.

In other common applications, a dispenser is provided that includes an open cavity that receives a food product that is not provided in a flexible package. In such embodiments, the food product is poured into the open cavity. When the supply of food product is emptied from the open cavity, the open cavity is refilled with the food product. Presently, dispensers are not available that can handle both flexible pouches and poured-in food products.

There remains a need for a dispenser that efficiently dispenses the food product received in either a flexible pouch or as a pour-in supply, such that little or no residual food product is lost or wasted when the dispenser is refilled. Furthermore, there remains a need for a dispenser with an efficient mechanism for driving the rod and the piston to thereby dispense the food product from the dispenser that is easy to use and clean. Through research and experimentation, the present inventors have developed the dispensers of the present disclosure that increase efficiency of the mechanism that drives the piston to thereby dispense the food product.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter In certain examples a dispenser for dispensing a viscous material contained in a flexible package includes a body extending along a longitudinal axis that has a first end, an opposite second end, a cavity configured to receive the flexible package, and a handle assembly coupled to the first end. The handle assembly has a fixed handle, a trigger pivotally coupled to the fixed handle, and a rod extending between the fixed handle and the trigger into the cavity along the longitudinal axis. A plurality of dispensing valves are positioned at the second end of the body and configured to dispense the viscous material, and a piston is movably disposed in the cavity for engagement with the flexible package. As the trigger is pivoted toward the fixed handle, the rod moves along the longitudinal axis toward the piston such that the piston engages the flexible package and the viscous material dispenses through the plurality of dispensing valves.

In certain examples, a dispenser for dispensing a viscous product contained in a flexible package includes a body extending along a longitudinal axis and having a first end, an opposite second end, a cavity configured to receive either the flexible package or a pour-in supply of product, and a handle assembly coupled to the first end. The handle assembly has a fixed handle, a trigger pivotally coupled to the fixed handle, a rod extending between the fixed handle and the trigger into the cavity along the longitudinal axis, a pawl member pivotally coupled to the fixed handle, and a gasket coupled to the first end of the body through which the rod slides. The gasket applies a radially inwardly force on the rod to thereby prevent movement of the rod away from the piston as the trigger is pivoted. A plurality of dispensing valves are positioned at the second end of the body, and a piston is movably disposed in the cavity for engagement with the flexible package. As the trigger is pivoted toward the fixed handle, the trigger pivots the pawl member such that pawl member engages the rod and axially moves the rod along the longitudinal axis. Accordingly, the rod moves the piston into engagement with the flexible package such that the viscous material dispenses through the plurality of dispensing valves.

Various other features, objects and advantages of the invention will be made apparent from the following description taken together with the drawings.

BRIEF DESCRIPTION OF THE DRAWINGS

The drawings illustrate modes presently contemplated of carrying out the present disclosure. In the drawings:

FIG. 11 is an exploded view of a handle assembly of the present disclosure;

FIGS. 12A-12B are partial cross sectional view of the dispenser that depict operation of the handle assembly.

DETAILED DESCRIPTION

Figure 1:
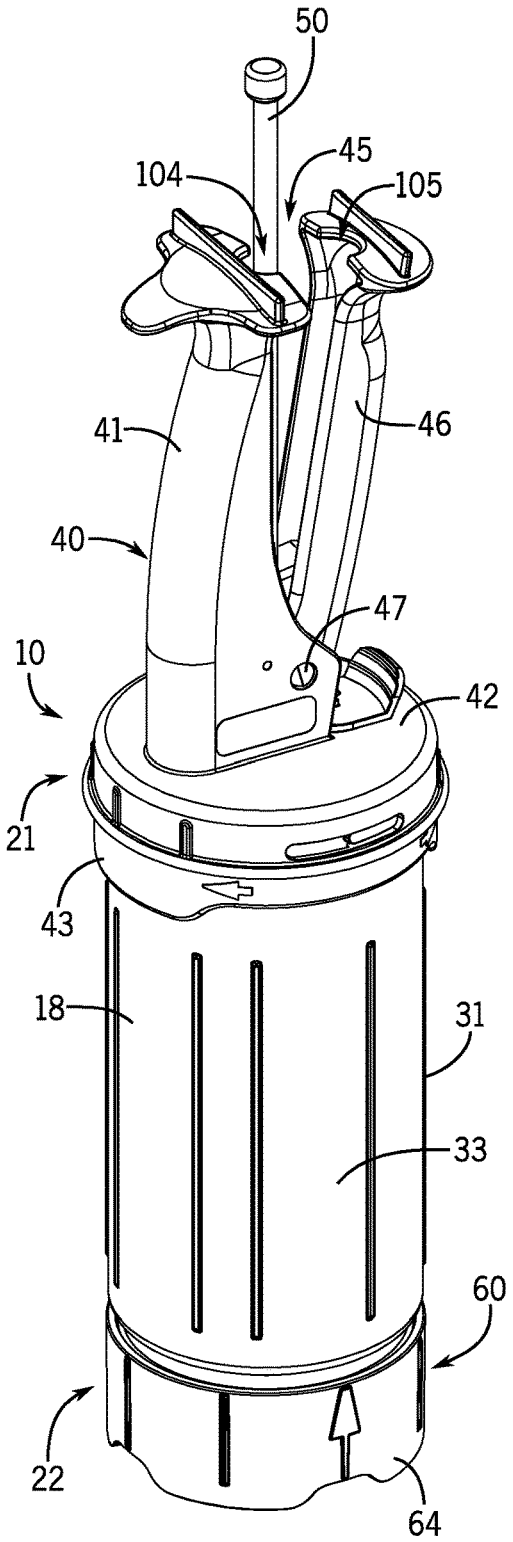
FIG. 1 is a perspective view of a dispenser in accordance with the present disclosure.
Figure 2:
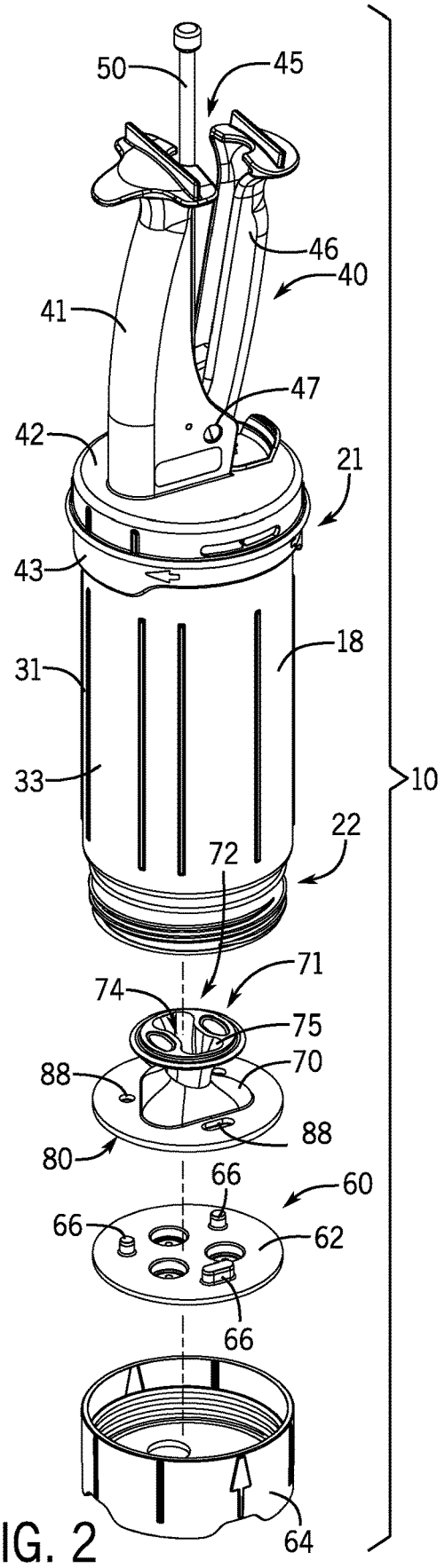
FIG. 2 is an exploded view of the dispenser shown in FIG. 1.
Figure 3:
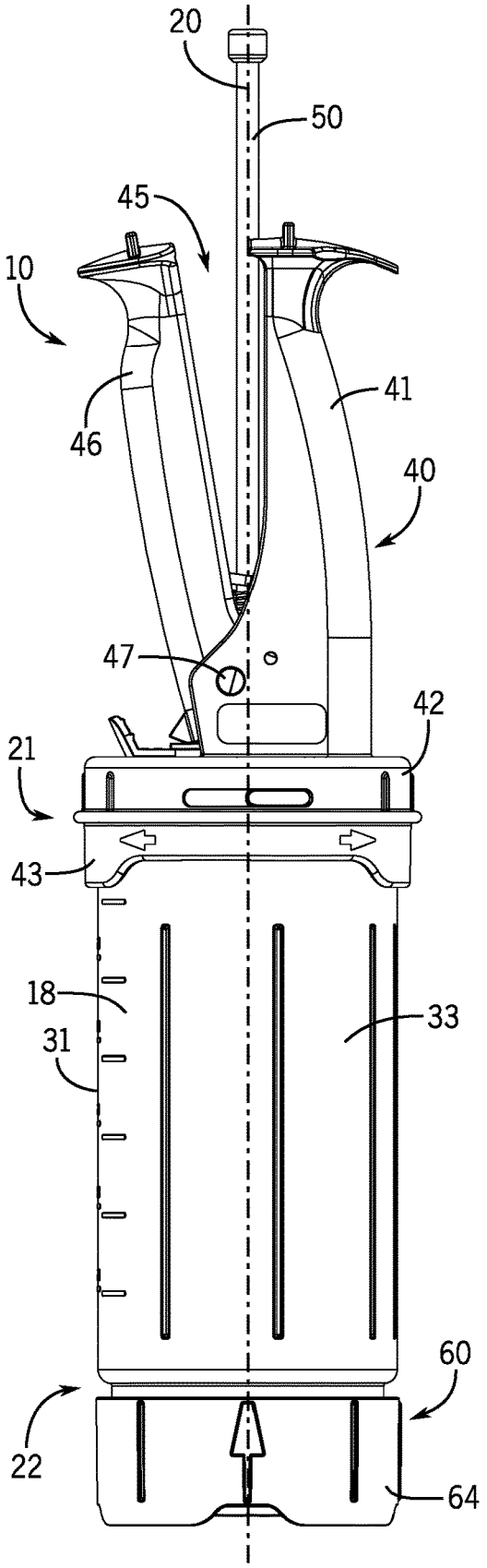
FIG. 3 is a side view of the dispenser shown in FIG. 1.
Figure 4:
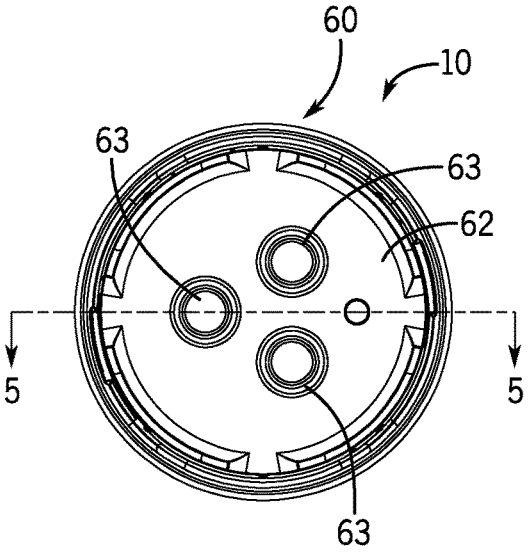
FIG. 4 is an end view of the dispenser shown in FIG. 1.

Depicted in FIGS. 1-5 is a dispenser 10 for dispensing viscous materials according to the present disclosure. The dispenser 10 has a body 18 that extends along a longitudinal axis 20 and defines a cavity 19 in which a flexible package 14 (FIG. 5) containing a food product is received. The flexible package 14 is typically pre-filled with a thick, flowable food product, such as ketchup, cheese or other similar product. The flexible package 14 is closed at first and second end walls 16, 17 to retain the food product within the flexible package prior to dispensing. The second end wall 17 of the flexible package 14 includes a dispensing fitment 23 and the portion of the end wall 17 aligned with the fitment 23 is weakened and thus designed to burst in response to a pressure applied to the first end wall 16 by a piston 52 so that the food product will flow out of the dispenser 10. Although the present disclosure is shown and described as being used with a flexible package 14, the cavity 19 could also receive a pour-in supply of food product to be dispensed. In such an embodiment, a fitment 23 could be placed in the cavity 19 and the flexible package would be eliminated.

The body 18 has a first end 21, an opposite, threaded second end 22, and a sidewall 31 extending between the ends 21, 22. The sidewall 31 has an interior surface 32 and an opposite, exterior surface 33. A wall member 24 (FIG. 5) extends radially inwardly from the interior surface 32 into the cavity 19 to divide the cavity 19 into a first cavity portion 19*a* (e.g. package receiving cavity) and second cavity portion 19*b* (e.g. insert receiving cavity). The wall member 24 has a first wall surface 26 positioned next to the package receiving cavity 19*a*, an opposite second wall surface 27 positioned next to the insert receiving cavity 19*b*, and a passage 25 extending between the surfaces 26, 27 such that the package receiving cavity 19*a* is in fluid communication with the insert receiving cavity 19*b*. The passage 25 is sized to receive the fitment 23 as illustrated.

The body 18 includes a handle assembly 40 that is removably coupled to the first end 21 of the body 18 and is operated by an operator to dispense food product from the dispenser 10. The handle assembly 40 includes a fixed handle 41 integrally joined to a cap 42 that engages with the first end 21 of the body 18. The cap 42 has a flange 44 that extends parallel to the longitudinal axis 20 in a direction away from the fixed handle 41. The flange 44 has threads that engage with corresponding threads on the exterior surface 33 of the sidewall 31. The fixed handle 41 has a first cutout 104 and the trigger 46 has a second cutout 105 that corresponds with the first cutout 104 such that when the trigger 46 is pivoted toward the fixed handle 41 the first and second cutouts 104, 105 define a passageway 106 (FIG. 12A) through which a rod 50 (described further herein below) slides. In one examples, the cutouts 104, 105 are semi-circular such that the resulting passageway 106 is circular. The shape of the passageway 106 corresponds to the shape or diameter of the rod 50 such that the rod 50 can freely slide through the passageway 106. to thereby couple the handle assembly 40 to the body 18.

Referring to FIGS. 11 and 12A-12B, the handle assembly 40 is shown in greater detail. The handle assembly 40 includes a trigger 46 pivotably attached to the fixed handle 41 such that the operator can pivot the trigger 46 into and between an open position (FIG. 12B) and a closed position (FIG. 12A). In operation, the operator pivots the trigger 46 relative to the fixed handle 41 to thereby dispense food product from the dispenser 10. The trigger 46 is pivotably attached to the fixed handle 41 by a pivot pin 47 which extends through respective aligned holes (not shown) in the trigger 46 and the fixed handle 41. The trigger 46 is pivoted into and out of a recess 45 defined in the fixed handle 41. The trigger 46 is normally biased by a first spring 48 (FIG. 5) to the open position as (FIG. 12B) and is designed to be moved against the bias of the first spring 48 to the closed position (FIG. 12A) substantially within the recess 45 and/or against the fixed handle 41. In certain examples, a second spring 49 (described further herein) is included to further bias the trigger 46 toward the open position (FIG. 12B). In the example depicted in FIGS. 12A-12B, the springs 48, 49 are spaced apart from each other along the rod 50.

The trigger 46 has a boss 55 that extends from the interior surface 56 of the trigger 46 toward the fixed handle 41. The boss 55 has a first surface 57 that contacts a pawl member 58 which is pivotally coupled to the fixed handle 41. In particular, the pawl member 58 has a first end 59*a* that is received in a channel 61 defined by the fixed handle 41. The pawl member 58 has an opposite second end 59*b* with a second surface 91. The pawl member 58 also has a hole 92 in which the rod 50 slides, and the hole 92 is defined by an edge surface 93 that selectively contacts the rod 50 when the trigger 46 pivots (described hereinbelow). The shape of the pawl member 58 can vary, and in the example depicted the pawl member 58 is "L"-shaped. A guide member 94 is also coupled to the trigger 46, and the guide member 94 has a hole 95 in which the rod 50 slides. As the trigger 46 pivots toward the fixed handle 41, the guide member 94 compresses the second spring 49 against the first end 21 of the body 18. A gasket 96 at the cap 42 prevents debris from entering the cavity 19*a* while still allowing the rod 50 to slide there through. A clip 97 is connected to the cap 42 to thereby prevent over rotation or pivoting of the trigger 46 away from the fixed handle 41 (see arrow B on FIG. 12B) as the first spring 48 returns to an uncompressed state (see FIG. 12B).

An elongated reciprocating rod 50 is mounted for axial movement along the longitudinal axis 20 in the package receiving cavity 19*a* as the trigger 46 is pivoted. A piston 52 is within the package receiving cavity 19*a* is incrementally moved by the rod 50 such that the piston 52 applies a pressure to the flexible package 14 and thus food product dispenses from the dispenser 10.

Referring back to FIG. 5, the piston 52 has an extended portion 78 with an opening that receives the rod 50 and a bearing surface 54 which acts on the flexible package 14. The shape of the bearing surface 54 corresponds to the shape of the first wall surface 26 of the wall member 24. When the piston 52 is moved into close proximity with the wall member 24, the bearing surface 54 and the first wall surface 26 sandwich the flexible package 14 there between such that substantially all of the food product is forced from the flexible package and through the passage 25. In an embodiment where the food product is a pour-in food product and the flexible package 14 is eliminated, the piston 52 would push the food product out of the cavity 19. Accordingly, little or no food product is trapped in the package receiving cavity 19*a*.

Figure 5:
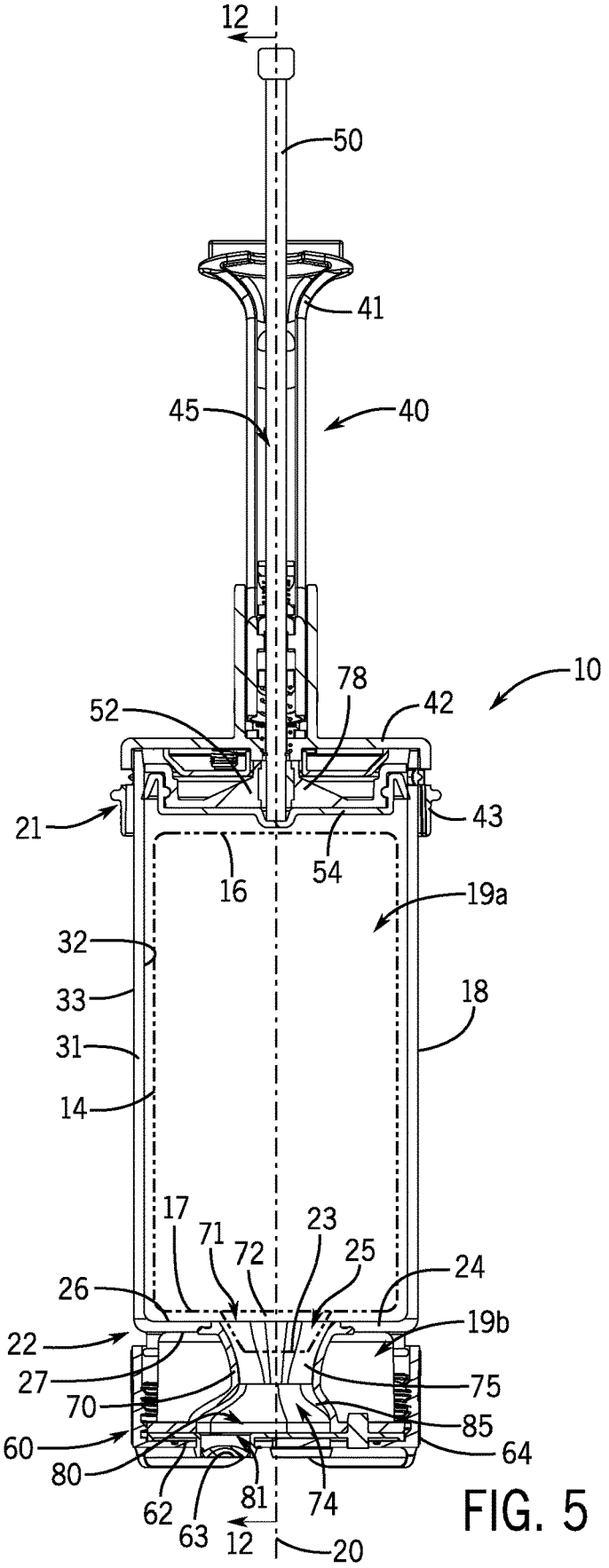
FIG. 5 is a cross sectional view of the dispenser shown in FIG. 1 along line 5-5 on FIG. 4.
Figure 6:
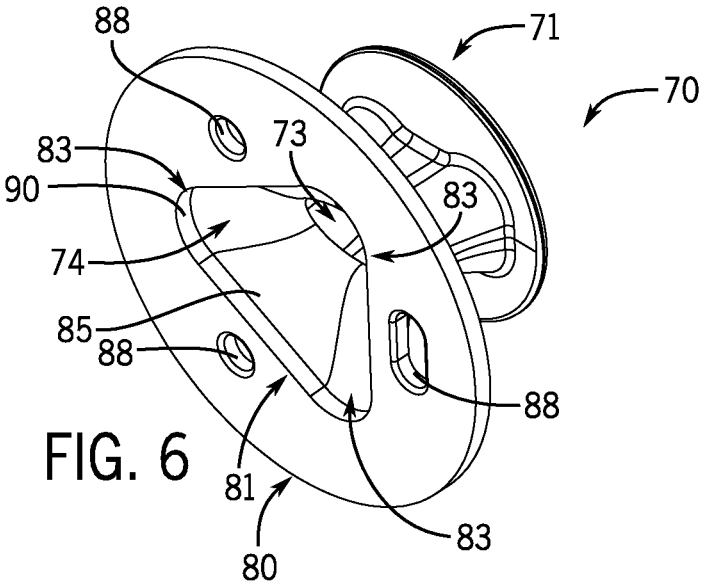
FIG. 6 is a perspective view of a diverter insert of the present disclosure.
Figure 7:
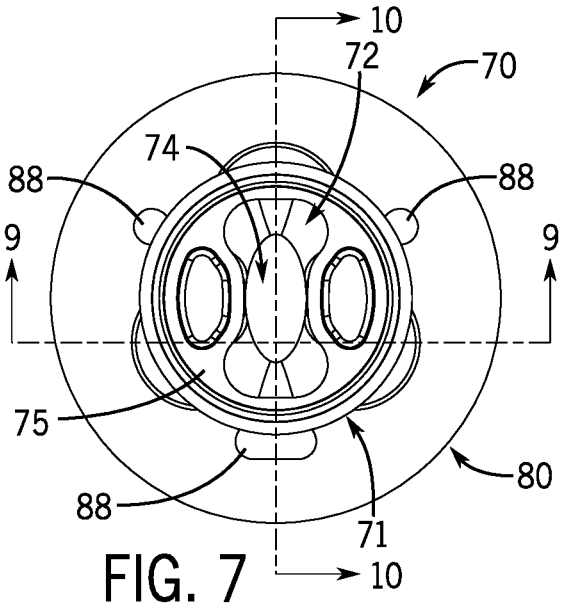
FIG. 7 is a top plan view of the diverter insert shown in FIG. 6.

In the example depicted in FIG. 5, the bearing surface 54 is flat and circular with a protruding center section and the first wall surface 26 of the wall member 24 is flat and circular with a recessed center section that corresponds with the protruding center section of the bearing surface 54. In another example (not shown), the bearing surface 54 and the first wall surface 26 are funnel-shaped and sloped toward the second end 22 of the body 18. In contrast, if the bearing surface 54 does not correspond to the first wall surface 26 of the wall member 24, an amount of food product becomes trapped there between in the package receiving cavity 19*a*. For instance, if the bearing surface 54 is circular and flat and the first wall surface 26 of the wall member 24 is funnel-shaped and sloped toward the second end 22 of the body 18, food product will become trapped between these surfaces 26, 54 due the bearing surface 54 contacting the wall member 24 before all the food products thereby stopping movement of the piston 52.

The food product passing through the fitment 23 centered in the passage 25 in the wall member 24 is received into a diverter insert 70. The diverter insert 70 is retained in the insert receiving cavity 19*b* by a removable collar assembly 60 that is coupled to the second end 22 of the body 18. The collar assembly 60 includes a dispensing disc 62 having a plurality of one-way flexible dispensing valves 63. Each of the dispensing valves 63 allows the food product to exit from the dispenser 10. A cover 64 engages with the threaded second end 22 of the body 18 to hold the dispensing disc 62 in place. The cover 64 forces the dispensing disc 62 into contact with the diverter insert 70 such that a fluid tight seal is formed between the diverter insert 70 and the dispensing disc 62 and between the diverter insert 70 and the wall member 24. The dispensing disc 62 can include any number and size of dispensing valves 63. In the example depicted in FIG. 4, the dispensing disc 62 includes three circular dispensing valves 63. The dispensing valves 63 are designed as one-way valves having a slit opening near the center and are formed from a flexible material, such as silicone. The dispensing disc 62 is interchangeable with other dispensing discs depending on the desired dispensing pattern for the dispenser 10. The dispensing valves 63 are each radially offset from the longitudinal axis 20. In the embodiment shown in FIG. 2, the dispensing disc 62 includes alignment bosses 66 which facilitate alignment of the diverter insert 70 with the dispensing disc 62 and the included dispensing valves 63. One of the alignment bosses 66 is larger and shaped differently than the other alignment bosses 66 to ensure proper alignment of the diverter insert 70 and the dispensing disc 62.

The diverter insert 70 disposed in the insert receiving cavity 19*b* is configured to receive the food product passing through the passage 25 and divert the food product to each of the dispensing valves 63. The diverter insert 70 is centered on the longitudinal axis 20. As shown in FIGS. 6-10, the diverter insert 70 includes an inlet end 71 having an inlet opening 72 through which the food product in received into a chamber 74 defined in the diverter insert 70. The chamber 74 is tapered from the inlet opening 72 to a transition area 73. At the transition area 73, the material enters into one of a plurality of dispensing sections 83 which extend through the lower portion of the diverter insert 70 and each terminate at an outlet end 80. Each of the dispensing sections 83 terminates at one of the plurality of outlet openings 81 through which the food product is dispensed to one of the dispensing valves 63.

Figure 8:
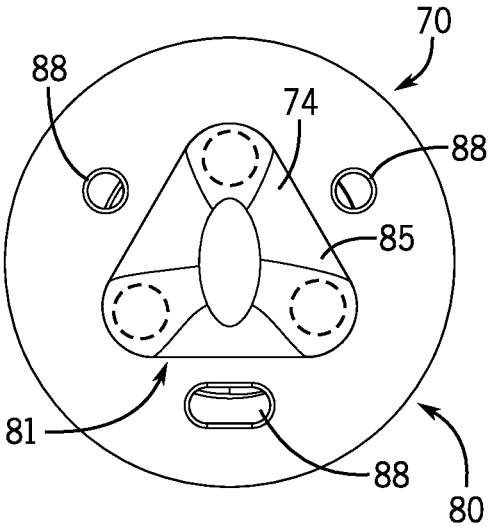
FIG. 8 is a bottom plan view of the diverter insert shown in FIG. 6.
Figure 9:
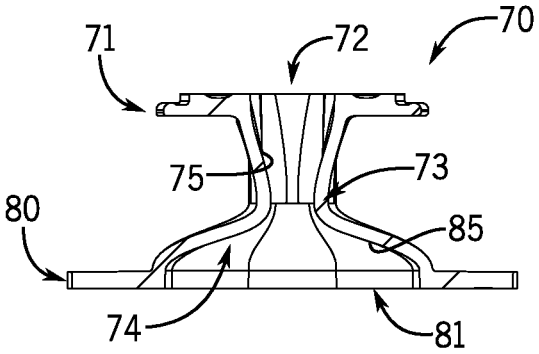
FIGS. 9-10 are cross sectional views of the diverter insert shown in FIG. 6 along line 9-9 and line 10-10 on FIG. 7.
Figure 10:
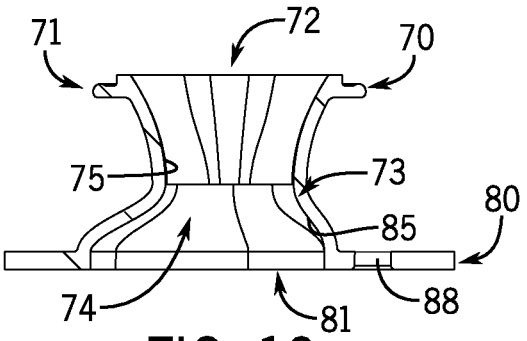

The chamber 74 has a first interior sidewall 75 that radially inwardly slopes from the inlet opening 72 toward the longitudinal axis 20 and terminates at a second interior sidewall 85 which radially outwardly slopes away from the longitudinal axis 20 and toward the outlet openings 81. The first interior sidewall 75 radially inwardly diverts the food product toward the longitudinal axis 20 and the second interior sidewall 85 radially outwardly diverts the food product toward the dispensing valves 63. The outlet openings 81 are each shaped such that food product is directed toward one of the dispensing valves 63. For example, as shown in FIG. 8, the outlet end 80 has three dispensing sections 83 that terminate in the outlet openings 81 and are equally radially spaced apart from each other relative to the longitudinal axis 20. The dispensing sections 83 and the corresponding outlet openings 81 generally align with the four dispensing valves 63 (see FIG. 4) of the dispensing disc 62 (note that the dispensing valves 63 are shown in dashed lines on FIG. 8). The outlet openings 81 define an inner edge 90 that is undulated or wavy. Furthermore, each dispensing section 83 directs the flow of material to the corresponding outlet opening 81, which is generally shaped to match the shape of the dispensing valves 63, and the second interior sidewall 85 includes smooth, curved surfaces that allow the food product easily flow through the chamber 74 and through the outlet openings 81.

The outlet end 80 of the diverter insert includes alignment holes 88 that receive the alignment bosses 66 on the dispensing disc 62 to align the dispensing sections 83 with the dispensing valves 63. One of the alignment holes 88 is larger and shaped differently than the other alignment holes 88 to ensure proper alignment of the diverter insert 70 and the dispensing disc 62. Proper alignment of the dispensing sections 83 and the dispensing valves 63 is also important to ensure efficient and effective flow of the food product through the diverter insert 70 and to the dispensing valves 63. The dispensing sections 83 are in fluid communication with each other (e.g. there are no barrier structures between the dispensing sections 83).

Referring to FIGS. 11 and 12A-12B, an example operation of the dispenser 10 is described herein below, and a person of ordinary skill in the art will recognize that the operation of the dispenser 10 can vary.

To load the dispenser 10 with the flexible package 14, the handle assembly 40 is decoupled from the body 18 and the flexible package 14 is inserted into the package receiving cavity 19*a* and the fitment 23 is located within the passage 25 (see FIG. 5). The handle assembly 40 is then coupled to the body 18 thereby confining the flexible package 14 in the package receiving cavity 19*a*.

To dispense the food product, the trigger 46 is squeezed towards the fixed handle 41 (see arrow A on FIG. 12A) such that the first surface 57 of the boss 55 contacts and acts on (e.g., cams) the second surface 91. Accordingly, the pawl member 58 pivots in the first direction (see arrow C on FIG. 12A). As the pawl member 58 pivots in the first direction (see arrow C), the edge surface 93 engages (e.g., frictionally contacts) the rod 50 and thereby axially moves (e.g., pushes) the rod 50 and the piston 52 toward the flexible package 14 (see arrow D on FIG. 12A). As such, the rod 50 and the piston 52 incrementally advance within the packaging receiving cavity 19*a* thereby causing the food product to dispense from the dispenser 10. In addition, as the trigger 46 is squeezed towards the fixed handle 41, the guide member 94 compresses the second spring 49 against the first end 21 of the body 18 and guides the rod 50 is the axial direction to thereby prevent radial movement of the rod 50. Furthermore, as the rod 50 axially moves in a direction toward the piston 52, the rod 50 incrementally slides through the gasket 96. The gasket 96 is sized and/or shaped to exert radially inwardly directed compression forces on the rod 50. Accordingly, when the trigger 46 moves toward the open position (FIG. 12B) the gasket 96 prevents longitudinal movement of the rod 50 away from the piston (see arrow E on FIG. 12B). Thus, the piston 52 remains in contact with and maintains pressure on the flexible package 14. Accordingly, pressure is constantly applied to the flexible packaging during repeated squeezing and releasing of the trigger 46 thereby increasing the efficiency and operation of the dispenser 10.

When the trigger 46 is released, the first spring 48 applies a spring force to the pawl member 58 such that the pawl member 58 pivots in a second direction (see arrow F on FIG. 12B) and the second spring 49 applies a spring force to the guide member 94 such that the guide member 94 moves in a second direction (see arrow E on FIG. 12B). As the pawl member 58 pivots in the second direction (arrow F), the second surface 91 acts on (e.g., cams) the first surface 57 of the boss 55 to thereby pivot the trigger 46 away from the fixed handle 41 (see arrow B on FIG. 12B). Furthermore, as the pawl member 58 pivots toward the open position (FIG. 12A) the edge surface 93 is spaced apart from (e.g., does not contact) the rod 50 and thus the pawl member 58 freely passes along the rod 50. Accordingly, the pawl member 58 does not act on (e.g., pull) the rod 50 away from the piston 52 or the flexible container 14. Repeated squeezing and releasing of the trigger 46 will enable the rod 50 and the piston 52 to be moved toward the flexible package 14 until the food product is fully forced from the flexible package 14.

The initial incremental movement of the piston 52 toward the flexible package 14 exerts a pressure on the flexible package 14 which will cause bursting of the second end wall 17 of the flexible package 14 at the location of the fitment 23. Further incremental movement of the piston 52 compresses the flexible package 14 causing the food product to be forced out of the flexible package 14 and through the passage 25 defined in the wall member 24. The food product is then received into the chamber 74 of the diverter insert 70. The chamber 74 fills with food product, and after the chamber 74 is completely filled with food product, additional food product received into the chamber 74 causes food product to be diverted into the dispensing sections 83, which divert the food product toward one of the dispensing valves 63. The trigger 46 is repeatably squeezed to dispense the food product from the dispenser 10.

To reload or refill the dispenser 10 when the flexible package 14 is empty, the handle assembly 40 is decoupled from the body 18 so that the used flexible package 14 can be removed and a new flexible package 14 can be inserted into the package receiving cavity 19*a*. To reset the handle assembly 40, the piston 52 and the rod 50 are moved to its original position by applying a force in an axial direction away from the body (see arrow E on FIG. 12B) to the piston 52 and/or the rod 50 that overcomes the compression forces exerted by the gasket 96. Thereafter, the handle assembly 40 is recoupled to refilled body 18, as described above. While the new flexible package 14 is inserted into the package receiving cavity 19*a*, the food product in the chamber 74 is retained in the chamber 74 due to the vicious properties of the food product and the shape of the chamber 74. If for instance, the dispenser 10 is inverted to remove the used flexible package 14 the food product in the chamber 74 remains in the chamber 74 and does not spill out. As new food product is forced into the chamber 74, the residual food product in the chamber 74 is dispensed through the dispensing valves 63. As such, food product in the diverter insert 70 is not wasted or lost when the dispenser 10 is refilled.

The present inventors have found that the dispenser 10 and the diverter insert 70 of the present disclosure greatly reduces the amount of food product which must be cleaned/removed from the dispenser 10 each time the dispenser is refilled. In conventional dispensers, an amount of residual food product is often trapped below the piston and above the dispensing opening due to the piston not fully compressing the flexible package and dispensing the food product there from. Accordingly, when the nearly emptied flexible package is removed from the dispenser the residual food product is trapped in the flexible package and/or in the dispenser between the piston and the dispensing holes. This residual food product is often placed in the trash or cleaned from the dispenser prior to a new flexible package being added to the dispenser. In contrast, the dispenser 10 of the present disclosure minimizes or eliminates the amount of residual food product that is wasted. Accordingly, the dispensing efficiency of the dispenser 10 of the present disclosure is greater than conventional dispensers. The diverter insert 70 of the present disclosure increases the flow rate of the food product between the flexible package 14 and the dispensing valves 63 and reduces buildup of large particles that may normally collect in at the sides or corners of conventional dispensers with conventional nozzles.

In the present disclosure, certain terms have been used for brevity, clarity and understanding. No unnecessary limitations are to be inferred therefrom beyond the requirement of the prior art because such terms are used for descriptive purposes and are intended to be broadly construed. The different systems, apparatuses and method steps described herein may be used alone or in combination with other systems, apparatus and method steps. It is to be expected that various equivalents, alternatives and modifications are possible within the scope of the appended claims. Each limitation in the appended claims is intended to invoke interpretation under 35 USC § 112(f), only if the term "means for" or "step for" are explicitly recited in the respective limitation.

What is claimed is:

1. A dispenser for dispensing a viscous material contained in a flexible package, the dispenser comprising:

a body extending along a longitudinal axis and having a first end, an opposite second end, a cavity configured to receive the flexible package, and a handle assembly coupled to the first end, the handle assembly has a fixed handle, a trigger pivotally coupled to the fixed handle, a rod extending between the fixed handle and the trigger into the cavity along the longitudinal axis, and a gasket coupled to the first end of the body and through which the rod slides, wherein the gasket applies a radially inwardly force on the rod to thereby prevent movement of the rod away from the piston as the trigger is pivoted;

a plurality of dispensing valves positioned at the second end of the body and configured to dispense the viscous material; and a piston movably disposed in the cavity for engagement with the flexible package; and wherein as the trigger is pivoted toward the fixed handle the rod moves along the longitudinal axis toward the piston and the piston into engagement with the flexible package such that the viscous material dispenses through the plurality of dispensing valves.

2. The dispenser according to claim 1, wherein the trigger and the fixed handle extend along the longitudinal axis away from the body.

3. The dispenser according to claim 2, wherein the fixed handle has a first cutout and the trigger has a second cutout, and wherein as the trigger is pivoted toward the fixed handle the first and the second cutouts define a passageway through which the rod slides.

4. The dispenser according to claim 1, wherein the handle assembly has a first spring that biases the trigger away from the fixed handle.

5. The dispenser according to claim 4, wherein the first spring is disposed around the rod, and wherein the rod slides relative to the spring.

6. The dispenser according to claim 5, wherein the handle assembly has a second spring disposed around the rod and spaced apart from the first spring, and wherein the second spring further biases the trigger away from the fixed handle.

7. The dispenser according to claim 6, wherein the handle assembly has a guide member coupled to the trigger such that as the trigger is pivoted toward the fixed handle the second spring is compressed between the guide member and the first end of the body and the guide member prevents radial movement of the rod.

8. The dispenser according to claim 1, wherein the handle assembly has a pawl member pivotally coupled to the fixed handle, and wherein as the trigger is pivoted toward fixed handle the trigger pivots the pawl member in a first direction such that the pawl member engages the rod and axially moves the rod along the longitudinal axis toward the piston.

9. The dispenser according to claim 8, wherein the pawl assembly has a hole defined by an interior edge surface, wherein the rod is slidably received in the hole, and wherein as the trigger is pivoted toward the fixed handle the interior edge surface engages the rod; and wherein as the trigger is pivoted away from the fixed handle the interior edge surface is spaced apart from the rod.

10. The dispenser according to claim 9, wherein the handle assembly has a first spring that biases the trigger away from the fixed handle, and wherein as the trigger pivots the pawl member the pawl member compresses the first spring.

11. The dispenser according to claim 10, wherein the pawl member has a first end and an opposite second end, and wherein the fixed handle defines a channel in which the first end is received.

12. The dispenser according to claim 11, wherein the trigger has a boss that extends toward the fixed handle and engages the second end of the pawl member.

13. The dispenser according to claim 12, wherein the second end of the pawl member has a first surface and the boss has a second surface that contacts the first surface as the trigger is pivoted.

14. The dispenser according to claim 12, wherein the first spring pivots the pawl member in a second direction opposite the first direction such that the second end of the pawl member acts on the boss of the trigger to thereby pivot the trigger away from the fixed handle.

15. The dispenser according to claim 14, wherein the handle assembly has a guide member that prevents radial movement of the rod.

16. A dispenser for dispensing a viscous product contained in a flexible package, the dispenser comprising:

a body extending along a longitudinal axis and having:

a first end;

an opposite second end;

a cavity configured to receive the flexible package, and a handle assembly coupled to the first end, the handle assembly having:

a fixed handle;

a trigger pivotally coupled to the fixed handle;

a rod extending between the fixed handle and the trigger into the cavity along the longitudinal axis;

a pawl member pivotally coupled to the fixed handle; and a gasket coupled to the first end of the body through which the rod slides, the gasket applies a radially inwardly force on the rod to thereby prevent movement of the rod away from the piston as the trigger is pivoted; and a plurality of dispensing valves positioned at the second end of the body; and a piston movably disposed in the cavity for engagement with the flexible package;

wherein as the trigger is pivoted toward the fixed handle the trigger pivots the pawl member such that pawl member engages the rod and axially moves the rod along the longitudinal axis, and wherein the rod moves the piston into engagement with the flexible package such that the viscous material dispenses through the plurality of dispensing valves.

17. The dispenser according to claim 16, wherein the pawl assembly has a hole defined by an edge surface, wherein the rod is slidably received in the hole, and wherein as the trigger is pivoted toward the fixed handle the edge surface engages the rod; and wherein as the trigger is pivoted away from the fixed handle the edge surface is spaced apart from the rod.

18. The dispenser according to claim 17, wherein the handle assembly has a spring that biases the trigger away from the fixed handle, and wherein as the trigger pivots the pawl member the pawl member compresses the spring.

19. The dispenser according to claim 18, wherein the pawl member has a first end and an opposite second end, and wherein the fixed handle defines a channel in which the first end is received.

* * * * *